US009863429B2

(12) United States Patent
Jones et al.

(10) Patent No.: US 9,863,429 B2
(45) Date of Patent: Jan. 9, 2018

(54) ROTOR ASSEMBLY FOR A TURBOMACHINE

(75) Inventors: David Michael Jones, Malmesbury (GB); Geoffrey Michael Burlington, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 794 days.

(21) Appl. No.: 13/591,911

(22) Filed: Aug. 22, 2012

(65) Prior Publication Data

US 2013/0052018 A1 Feb. 28, 2013

(30) Foreign Application Priority Data

Aug. 26, 2011 (GB) ..... 1114786.5

(51) Int. Cl.

| | |
|---|---|
| ***F01D 25/16*** | (2006.01) |
| ***F04D 25/06*** | (2006.01) |
| ***F04D 29/056*** | (2006.01) |
| ***F04D 29/42*** | (2006.01) |

(52) U.S. Cl.

CPC ..... *F04D 25/0606* (2013.01); *F04D 29/056* (2013.01); *F04D 29/4213* (2013.01); *F04D 29/4226* (2013.01)

(58) Field of Classification Search

CPC .. F04D 25/062; F04D 25/064; F04D 25/0646; F04D 29/04; F04D 29/042; F04D 29/049; F04D 29/052; F04D 29/054; F04D 29/059; F04D 29/62; F04D 29/668; F04D 29/056

See application file for complete search history.

(56) References Cited

U.S. PATENT DOCUMENTS

| | | | | |
|---|---|---|---|---|
| 5,096,396 | A | 3/1992 | Welch | |
| 5,316,440 | A | 5/1994 | Kijima et al. | |
| 5,427,498 | A * | 6/1995 | Lehe et al. | 415/58.2 |
| 5,459,361 | A | 10/1995 | Morioka | |
| 5,549,449 | A | 8/1996 | McInerney et al. | |
| 5,618,168 | A | 4/1997 | Moon | |
| 6,413,039 | B1 | 7/2002 | Morris et al. | |
| 6,439,845 | B1 | 8/2002 | Veres | |
| 6,447,631 | B1 | 9/2002 | Schaehl et al. | |
| 6,506,034 | B1 | 1/2003 | Lentz et al. | |
| 2005/0158172 | A1 | 7/2005 | Snyder et al. | |

(Continued)

FOREIGN PATENT DOCUMENTS

| | | |
|---|---|---|
| DE | 3137981 | 4/1983 |
| DE | 4038775 | 6/1992 |

(Continued)

OTHER PUBLICATIONS

International Search Report and Written Opinion dated Nov. 20, 2012, directed to International Application No. PCT/GB2012/052050; 8 pages.

(Continued)

*Primary Examiner* — Woody Lee, Jr.
*Assistant Examiner* — Maxime Adjagbe
(74) *Attorney, Agent, or Firm* — Morrison & Foerster LLP

(57) ABSTRACT

A rotor assembly having a shaft, a bearing assembly, an impeller and a shroud. The impeller and the bearing assembly are mounted to the shaft, and the shroud is mounted to the bearing assembly so as to cover the impeller.

16 Claims, 3 Drawing Sheets

(56) References Cited

U.S. PATENT DOCUMENTS

| | | | | |
|---|---|---|---|---|
| 2005/0260069 | A1 | 11/2005 | Hsu et al. | |
| 2009/0027592 | A1 | 1/2009 | Motomatsu | |
| 2009/0196770 | A1* | 8/2009 | Yu | F04D 29/053 417/353 |
| 2010/0181875 | A1 | 7/2010 | Tamaoka et al. | |
| 2010/0215485 | A1* | 8/2010 | Childe et al. | 415/203 |
| 2010/0215500 | A1* | 8/2010 | Jones et al. | 416/204 A |
| 2011/0044810 | A1 | 2/2011 | Ions | |
| 2013/0052019 | A1 | 2/2013 | Ions et al. | |
| 2016/0265546 | A1 | 9/2016 | Ions et al. | |

FOREIGN PATENT DOCUMENTS

| | | |
|---|---|---|
| DE | 10 2009 052 919 | 5/2011 |
| FR | 2827345 | 1/2003 |
| GB | 331375 | 7/1930 |
| GB | 2467964 | 8/2010 |
| GB | 2467965 | 8/2010 |
| GB | 2467967 | 8/2010 |
| GB | 2467969 | 8/2010 |
| JP | 2-64726 | 5/1990 |
| JP | 2003-294050 | 10/2003 |
| JP | 2003-322026 | 11/2003 |
| JP | 2008-291657 | 12/2008 |
| JP | 2011-94618 | 5/2011 |
| WO | WO-2005/054694 | 6/2005 |
| WO | WO-2011/033800 | 3/2011 |
| WO | WO-2011/057738 | 5/2011 |

OTHER PUBLICATIONS

Search Report dated Dec. 13, 2011, directed to counterpart GB Application No. 1114786.5; 1 page.

Ions et al., U.S. Office Action dated Jul. 17, 2015, directed to U.S. Appl. No. 13/592,927; 15 pages.

Ions et al., U.S. Office Action dated Mar. 1, 2016, directed to U.S. Appl. No. 13/592,927; 17 pages.

* cited by examiner

ROTOR ASSEMBLY FOR A TURBOMACHINE

REFERENCE TO RELATED APPLICATIONS

This application claims the priority of United Kingdom Application No. 1114786.5, filed Aug. 26, 2011, the entire contents of which are incorporated herein by reference.

FIELD OF THE INVENTION

The present invention relates to a rotor assembly for a turbomachine.

BACKGROUND OF THE INVENTION

The rotor assembly of a turbomachine may comprise an impeller that rotates relative to a shroud fixed within the turbomachine. During operation, the rotor assembly vibrates due to out-of-balance forces. As a result, the impeller vibrates relative to the shroud, which generates noise.

SUMMARY OF THE INVENTION

In a first aspect, the present invention provides a rotor assembly comprising a shaft, a bearing assembly, an impeller and a shroud, the impeller and the bearing assembly being mounted to the shaft, and the shroud being mounted to the bearing assembly so as to cover the impeller.

In mounting the shroud to the bearing assembly, the impeller is free to rotate relative to the shroud. Since the shroud forms part of the rotor assembly, displacement of the impeller due to vibration of the rotor assembly is accompanied by displacement of the shroud. Accordingly, the clearance between the impeller and the shroud is maintained irrespective of vibration of the rotor assembly. As a result, less noise is generated by the rotor assembly during operation. Mounting the shroud to the bearing assembly also enables a well-defined clearance to be established between the impeller and the shroud. In particular, a clearance may be established that is not influenced by the mounting or alignment of the rotor assembly within the turbomachine.

The bearing assembly may comprise a pair of spaced bearings surrounded by sleeve. The shroud is then mounted to the sleeve, which provides a relatively large surface over which the shroud may be mounted. As a result, a relatively good securement may be formed between the shroud and the bearing assembly. Additionally, the provision of spaced bearings surrounded by a sleeve increases the stiffness of the rotor assembly, which in turn results in a higher first flexural frequency. Consequently, the rotor assembly is able to operate at higher sub-critical speeds.

The bearing assembly may project into the impeller. As a result, a more compact rotor assembly may be realised. Additionally, the cantilever length between the impeller and bearing assembly is reduced. Consequently, unbalanced forces acting on the impeller result in a smaller moment of force and thus radial loading of the bearing assembly is reduced.

The shroud may be adhered to the bearing assembly. This then enables the shroud to be aligned concentrically with the impeller without the need for tight tolerances on the inner diameter of the shroud and/or the outer diameter of the bearing assembly.

The impeller and the shroud may be formed of plastic. This then has the advantage of reducing the cost and/or weight of the rotor assembly. The dimensional and geometric tolerances typically associated with plastic components may mean that plastic is unsuitable for use in certain conventional turbomachines. For example, the resulting tolerance stack may require an unacceptably large impeller-shroud clearance. In contrast, by mounting the shroud to the bearing assembly, a well-defined impeller-shroud clearance may be achieved. Accordingly, a plastic impeller and shroud may be employed whilst maintaining an acceptable impeller-shroud clearance.

In a second aspect, the present invention provides a rotor assembly comprising a shaft, a bearing assembly, an impeller and a shroud, wherein the impeller and the bearing assembly are mounted to the shaft, the bearing assembly comprises a pair of bearings surrounded by a sleeve, and the shroud is adhered to the sleeve so as to cover the impeller.

In a third aspect, the present invention provides a turbomachine comprising a frame and a rotor assembly, the rotor assembly comprising a shaft, a bearing assembly, an impeller and a shroud, wherein the impeller and the bearing assembly are mounted to the shaft, the shroud is mounted to the bearing assembly so as to cover the impeller, and the rotor assembly is mounted to the frame at the shroud or bearing assembly Accordingly, when the rotor assembly vibrates, displacement of the impeller relative to the frame is accompanied by an equivalent displacement of the shroud. As a result, the impeller-shroud clearance is maintained despite movement of the rotor assembly relative to the frame.

The rotor assembly may be mounted to the frame at the shroud and at the bearing assembly. By mounting the rotor assembly at two points that are spaced axially, the stiffness of the rotor assembly is increased and thus a higher first flexural frequency is achieved.

The rotor assembly may be soft mounted to the frame at the shroud or bearing assembly. For example, the rotor assembly may be mounted to the frame by an o-ring that is located in a seat of the shroud or bearing assembly. Consequently, less of the vibration of the rotor assembly is translated to the frame. Additionally, there is reduced loading of the bearing assembly and the first flexural frequency of the rotor assembly is increased.

In a fourth aspect, the present invention provides a turbomachine comprising a frame and a rotor assembly, the rotor assembly comprising a shaft, a bearing assembly, an impeller and a shroud, wherein the impeller and the bearing assembly are mounted to the shaft, the shroud is adhered to the bearing assembly so as to cover the impeller, and the rotor assembly is soft mounted to the frame at the bearing assembly and at the shroud.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
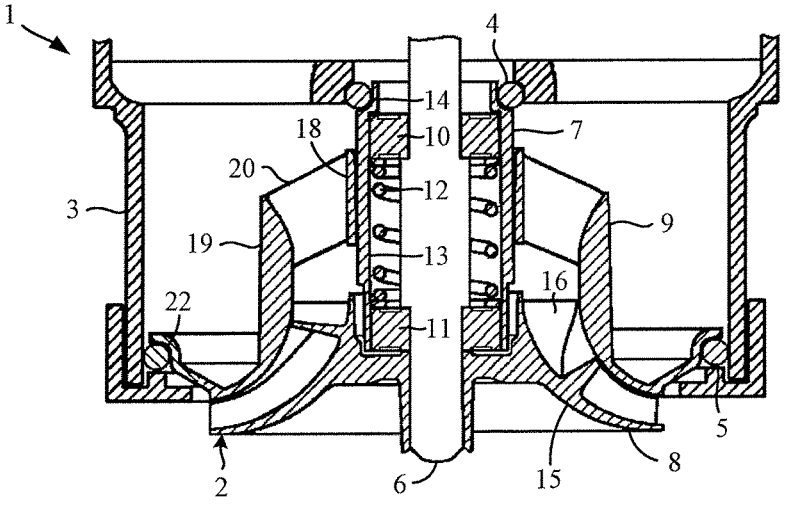
FIG. 1 is a sectional view of a turbomachine in accordance with the present invention.
Figure 2:
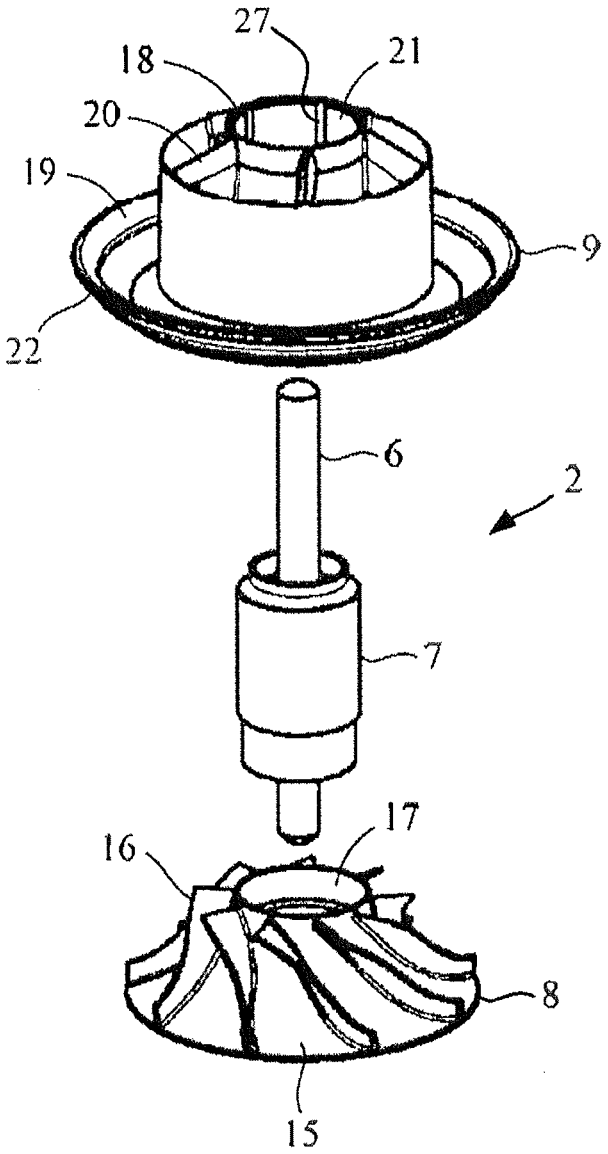
FIG. 2 is an exploded view of the rotor assembly of the turbomachine.

The turbomachine 1 of FIGS. 1 and 2 comprises a rotor assembly 2 mounted to a frame 3 by a pair of o-rings 4,5.

The rotor assembly 2 comprises a shaft 6, a bearing assembly 7, an impeller 8 and a shroud 9. The bearing assembly 7 and the impeller 8 are mounted to the shaft 6, and the shroud 9 is mounted to the bearing assembly 7 so as to cover the impeller 8.

The bearing assembly 7 comprises a pair of bearings 10,11, a spring 12, and a sleeve 13.

Each bearing 10,11 comprises an inner race, a cage supporting a plurality of balls, and an outer race. The bearings 10,11 are mounted to the shaft 6 on opposite sides of a stepped section. The inner race of each bearing 10,11 abuts the stepped section, which serves to space the two bearings 10,11 by a predetermined length.

The spring 12 surrounds the stepped section of the shaft 6 and applies an axial force to the outer races of the two bearings 10,11. Since the stepped section has a predetermined length and the spring 12 has a predetermined spring constant, each of the bearings 10,11 is preloaded with the same predetermined force.

The sleeve 13 surrounds the bearings 10,11 and the spring 12, and is secured to the outer race of each bearing 10,11 by an adhesive. An end of the sleeve extends axially beyond one of the bearings 10 and has a step down in diameter that defines a seat 14 for one of the o-rings 4.

The impeller 8 is a semi-open centrifugal impeller that comprises a base 15 and a plurality of blades 16. The base 15 has an aerodynamic upper surface around which the blades 16 are supported, and a central bore 17 through which the shaft 6 is received. The shaft 6 is then secured to the impeller 8 by interference fit and/or an adhesive join.

The shroud 9 comprises a hub 18, a hood 19 and a plurality of spokes 20 that extend radially between the hub 18 and the hood 19. The hub 18 is cylindrical and includes a central bore 21. The hood 19 is axially longer than the hub 18 and the spokes 20 extend between the hub 18 and an upper part of the hood 19. The inner surface of the hood 19 has an aerodynamic profile that corresponds to the edges of the blades 16 of the impeller 8. The outer perimeter of the hood 19 is shaped so as to define an annular seat 22 for the other of the o-rings 5.

The shroud 9 is secured to the bearing assembly 7 such that the shroud 9 covers the impeller 8. More particularly, the bearing assembly 7 extends through the bore in the hub 18 and is secured to the hub 18 by an adhesive.

The rotor assembly 2 is mounted to the frame 3 at both the bearing assembly 7 and at the shroud 9. More particularly, the rotor assembly 3 is soft mounted at each location by one of the o-rings 4,5. A first o-ring 4 is located in the seat 14 of the bearing assembly 7, and a second o-ring 5 is located in the seat 22 of the shroud 9.

During operation of the turbomachine 1, the rotor assembly 2 vibrates relative to the frame 3 due to out-of-balance forces. In mounting the shroud 9 to the bearing assembly 7, any displacement of the impeller 8 relative to the frame 3 is tracked by the shroud 9. As a result, the clearance between the impeller 8 and the shroud 9 is maintained irrespective of vibration. Accordingly, less noise is generated by the rotor assembly 2. In contrast, if the impeller 8 were to vibrate relative to the shroud 9, the vibration would compress and rarefy the surrounding air, thereby generating noise.

Mounting the shroud 9 to the bearing assembly 7 also enables a well-defined clearance to be established between the impeller 8 and the shroud 9. As described below, when manufacturing the rotor assembly 2, the impeller 8 and the shroud 9 can be brought into contact and then separated so as to establish a well-defined clearance. The clearance between the impeller 8 and the shroud 9 is not therefore influenced by the alignment of the rotor assembly 2 within the frame 3 of the turbomachine 1.

Mounting the shroud 9 to the bearing assembly 7 may also have benefits for a rotor assembly that is relatively flexible and/or is required to operate at or near the critical speed. For a conventional rotor assembly, vibration of the impeller relative to the shroud may be so great that the impeller-shroud clearance has to be increased in order to accommodate the vibration. Any increase in the clearance will, however, adversely affect the performance of the turbomachine. By mounting the shroud 9 to the bearing assembly 7, any vibration of the impeller 8 is tracked by the shroud 9. Accordingly, a smaller clearance may be employed, thereby improving the performance of the turbomachine 1.

The impeller 8 and/or the shroud 9 may be formed of materials or processes for which the dimensional and geometric tolerances might otherwise render them unsuitable for use in existing turbomachines. For example, the impeller 8 and the shroud 9 may be formed of plastic using a moulding process. By mounting the shroud 9 to the bearing assembly 7, a well-defined impeller-shroud clearance may nevertheless be obtained.

The provision of a bearing assembly 7 that comprises spaced bearings 10,11 surrounded by a sleeve 13 increases the stiffness of the rotor assembly 2. This in turn increases the frequency of the first flexural mode and thus the critical speed of the rotor assembly 2.

Since the bearings 10,11 are spaced by a predetermined distance and the spring 13 has a predetermined spring constant, the bearings 10,11 are preloaded with the same, well-defined force. The magnitude of the preload may therefore be defined so as to prevent skidding of the bearings 10,11 without the preload being excessive, which would otherwise result in poor bearing performance.

By projecting the bearing assembly 7 into the impeller 8, the axial length of the rotor assembly 2 is reduced. Furthermore, the cantilever length between the impeller 8 and the bearing assembly 7 is reduced and thus any out-of-balance forces acting on the impeller 8 will result in a smaller moment of force. Consequently, radial loading of the bearings 10,11 is reduced and thus the lifespan of the bearing assembly 7 is increased.

The rotor assembly 2 is mounted to the frame 3 at two locations that are spaced axially. This then provides good stability of the rotor assembly 2 within the frame 3. Additionally, the stiffness of the rotor assembly 2 is increased and thus a higher first flexural frequency is achieved. In soft-mounting the rotor assembly 2 to the frame 3, less of the vibration of the rotor assembly 2 is translated to the frame 3. Additionally, there is reduced loading of the bearing assembly 7 and the first flexural frequency of the rotor assembly 2 is increased. Nevertheless, in spite of the advantages of soft mounting, the rotor assembly 2 might conceivably be hard mounted to the frame 3 at one or more locations.

Any eccentricity in the alignment of the impeller 8 and the shroud 9 will result in a larger impeller-shroud clearance, which will adversely affect the performance of the turbomachine 1. Any eccentricity in the alignment of the two o-rings 4,5 will mean that the rotor assembly 2 is misaligned within the frame 3, i.e. the rotational axis of the rotor assembly 2 will be tilted. Again this is likely to adversely affect the performance of the turbomachine 1. By adhering the shroud 9 to the bearing assembly 7, the shroud 9 may be aligned concentrically with the shaft 6 prior to curing. Consequently, concentric alignment may be achieved between the impeller 8 and the shroud 9, and between the two o-rings 4,5.

The sleeve 13 of the bearing assembly 7 provides a relatively large surface over which the shroud 9 may be secured to the bearing assembly 7. As a result, a relatively good securement may be formed between the shroud 9 and the bearing assembly 7. Rather than employing an adhesive join, the shroud 9 may be secured to the bearing assembly 7 by interference fit. However, this then requires tighter tolerances on the inner diameter of the shroud 9 and the outer diameter of the bearing assembly 7 in order to ensure that the shroud 9 is concentrically aligned with the shaft 6. Tighter tolerances naturally increase the cost of the rotor assembly 2. By adhering the shroud 9 to the bearing assembly 7, concentricity may be achieved in a more cost effective manner. Moreover, manufacturing processes and materials may be used that would otherwise result in unacceptable tolerances for achieving an interference fit. For example, the shroud 9 may be formed of plastic by means of a moulding process without the need to machine the bore 21 of the shroud 9 after moulding.

The tolerance stack of the rotor assembly 2 may mean that a relatively large clearance is required between the shroud 9 and the bearing assembly 7 in order that the shroud 9 can be mounted concentrically. A large clearance may mean that the adhesive used to secure the shroud 9 to the bearing assembly 7 may leak from between the two components and contaminate the impeller 8 prior to curing. A higher viscosity adhesive may be used in order to prevent leaking. However, the time required to fill the space between the shroud 9 and the bearing assembly 7 then increases. Accordingly, a method will now be described that prevents adhesive leaking from between the shroud 9 and the bearing assembly 7 whilst maintaining a relatively fast filling time.

Figure 3:
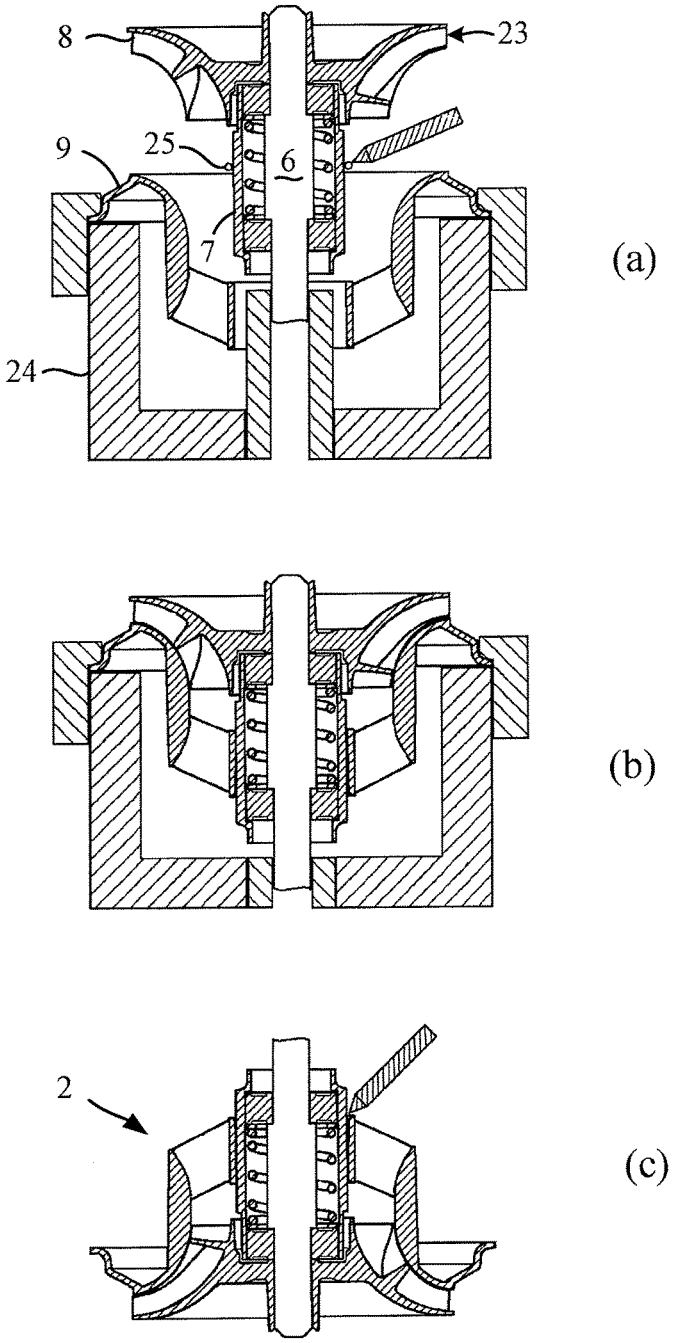
FIG. 3 illustrates stages in the manufacture of the rotor assembly.

Referring now to FIG. 3, the bearing assembly 7 and the impeller 8 are first secured to the shaft 6 to create a sub-assembly 23. The manner in which the bearing assembly 7 and the impeller 8 are secured to the shaft 6 is not pertinent to the present discussion. The sub-assembly 23 is mounted in one part of a jig 24 and the shroud 9 is mounted in another part. The jig 24 acts to align concentrically the o-ring seat 22 of the shroud 9 with the shaft 6.

The shroud 9 and the sub-assembly 23 are initially separated and a ring of high-viscosity adhesive 25 is applied to the bearing assembly 7, FIG. 3(*a*). The shroud 9 and sub-assembly 23 are then brought together, causing the bearing assembly 7 to be inserted into the bore 21 of the shroud 9, FIG. 3(*b*). The high-viscosity adhesive 25 forms an annular seal between the shroud 9 and the bearing assembly 7. Owing to the location at which the high-viscosity adhesive 25 is applied to the bearing assembly 7, the adhesive 25 forms the seal at a first end of the bore 21 of the shroud 9. The shroud 9 and the sub-assembly 23 are brought together such that the shroud 9 contacts the impeller 8, after which the shroud 9 and sub-assembly 23 are separated by a predetermined distance. This then serves to define the clearance between the impeller 8 and the shroud 9. The high-viscosity adhesive 25 is then cured and the rotor assembly 2 is removed from the jig 24.

The rotor assembly 2 is then inverted and a low-viscosity adhesive 26 is introduced into the space between the shroud 9 and the bearing assembly 7 via a second end of the bore 21, FIG. 3(*c*). The high-viscosity adhesive 25 acts as a stopper or plug for the low-viscosity adhesive 26, which rises within and fills the remainder of the space between the shroud 9 and the bearing assembly 7.

The bore 21 of the shroud 9 comprises one or more axial grooves 27, see FIG. 2. The low-viscosity adhesive 26 is introduced via the grooves 27, which act to deliver the low-viscosity adhesive 26 down to the high-viscosity adhesive 25. As the low-viscosity adhesive 26 continues to be introduced via the grooves 27, the adhesive 26 rises within the space between the shroud 9 and the bearing assembly 7 so as to drive out any air. This then reduces the risk of air entrapment, which would otherwise result in a weaker adhesive join. Additionally, the bore 21 of the shroud 9 is tapered. More particularly, the bore 21 tapers from the first end to the second end such that the second end is larger in diameter. Consequently, as the low-viscosity adhesive 26 rises, the air is driven out into an expanding volume, thus further reducing the risk of air entrapment.

The grooves 27 start at the second end of the bore 21 and terminate prior to the first end. This is an artefact of the moulding process used to manufacture the shroud 9. Nevertheless, there are advantages in terminating the grooves 27 prior to the first end of the bore 21. If the grooves 27 were to extend along the full length of the bore 21, there is a possibility that the high-viscosity adhesive 25 may fail to penetrate fully into one or more grooves 27; this will, of course, depend on the depth of the grooves 27 as well as the amount of high-viscosity adhesive 25 that is applied to the bearing assembly 7. As a result, the high-viscosity adhesive 25 may fail to form a complete seal between the shroud 9 and the bearing assembly 7. By terminating the grooves 27 prior to the first end of the bore 21, a complete seal can be formed without requiring an excessive amount of high-viscosity adhesive 25. Additionally, relatively deep grooves 27 may be employed for a quicker delivery of the low-viscosity adhesive 26.

Figure 4:
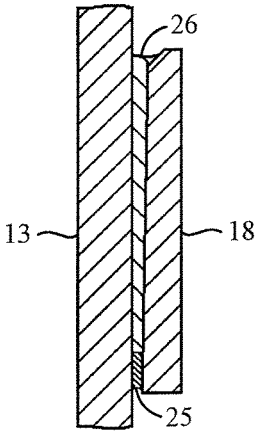
FIG. 4 is a sectional view of the adhesive join between the bearing assembly and the shroud of the turbomachine.

The second end of the bore 21 is chamfered, see FIG. 4. The chamfered portion serves as a reservoir for the rising low-viscosity adhesive 26. Consequently, tight controls on the amount of adhesive 26 introduced into the space between shroud 9 and bearing assembly 7 are not required.

After the low-viscosity adhesive 26 has been introduced, the adhesive 26 is cured. As illustrated in FIG. 4, the net result is that the high-viscosity adhesive 25 is located at the first end of the bore 21 of the shroud 9. The low-viscosity adhesive 26 then extends from the high-viscosity adhesive 25 to the second end of the bore 21. By employing two adhesives of different viscosity, the shroud 9 may be secured to the bearing assembly 7 relatively quickly without adhesive leaking from the between the two components. Moreover, by using a low-viscosity adhesive 26 to fill the space between the shroud 9 and the bearing assembly 7, any air that might be trapped on introducing the adhesive 26 is better able to rise to the top and escape. Consequently, the low-viscosity adhesive 26 promotes a more uniform layer of adhesive between the shroud 9 and the bearing assembly 7.

The low-viscosity adhesive 26 extends axially along a longer length of the bore 21 than that of the high-viscosity adhesive 25. The low-viscosity adhesive 26 is therefore intended to provide the bulk of the strength of the adhesive join between the shroud 9 and the bearing assembly 7. In contrast, the high-viscosity adhesive 25 is intended primarily to serve as a stopper for the low-viscosity adhesive 26. Consequently, a relatively cheap high-viscosity adhesive 25 may be employed for which the adhesive strength may be relatively poor.

In the method described above, the shroud 9 is mounted to a sub-assembly 23 for which the impeller 8 is already mounted to the shaft 6. Accordingly, it is only possible to insert the bearing assembly 7 into the bore 21 of the shroud 9 via the first end. Conceivably, however, the impeller 8 may be mounted to the shaft 6 after the shroud 9 has been mounted to the sub-assembly 23. In this instance, the bearing assembly 7 may be inserted into the bore 21 of the shroud 9 via the first end or the second end. Accordingly, the high-viscosity adhesive 25 may be applied to the bearing assembly 7 and/or the bore 21 of the shroud 9.

The method described above might equally or alternatively be used to secure other components of the rotor assembly 2, particularly when the size of the clearance between the components precludes the use of certain adhesives. For example, the dimensional tolerances associated with the impeller 8 may mean that the bore 17 of the impeller 8 must be relatively large in order that the outer diameter of the impeller 8 can be aligned concentrically with the shaft 6. The method may therefore be used to adhere the impeller 8 to the shaft 6. In this instance, a ring of high-viscosity adhesive is first applied to the shaft 6 and/or the bore 17 of the impeller 8. The shaft 6 is then inserted into the bore 17 of the impeller 8. Depending upon the order in which the rotor assembly 2 is manufactured, the impeller 8 may be made to contact the shroud 9 and then separated so as to define the impeller-shroud clearance. The high-viscosity adhesive is then cured and a low-viscosity adhesive is introduced into the space between the impeller 8 and the shaft 6. Finally, the low-viscosity adhesive is cured.

The method is therefore appropriate for securing components of a rotor assembly having a relatively large clearance in a time-efficient manner. Moreover, since the clearance may be large, the method may be used to secure components having relatively poor tolerances. In spite of the poor tolerancing, the components may nevertheless be aligned and secured concentrically. Accordingly, the method may be used to manufacture a concentric rotor assembly without the need for high-precision manufacturing, which can be expensive and/or preclude the use of certain materials and processes.

Although reference has been made to a high-viscosity adhesive and a low-viscosity adhesive, these labels have been employed merely to indicate that the two adhesives are of different viscosity. The labels should not be understood as providing any indication of the absolute viscosities of the adhesives.

The invention claimed is:

1. A rotor assembly for a turbomachine comprising a shaft, a bearing assembly, an impeller and a shroud, the impeller and the bearing assembly being mounted to the shaft, and the shroud being mounted to the bearing assembly so as to cover the impeller, wherein the shroud comprises a hub, a hood and a plurality of spokes that extend between the hub and the hood, wherein the hub comprises a bore, wherein the bearing assembly extends through the bore and is secured to the hub, and wherein the impeller generates an airflow during operation of the turbomachine and the plurality of spokes are positioned upstream of the airflow relative to the impeller.

2. The rotor assembly of claim 1, wherein the bearing assembly comprises a pair of bearings surrounded by a sleeve.

3. The rotor assembly of claim 1, wherein the bearing assembly projects into the impeller.

4. The rotor assembly of claim 1, wherein the shroud is adhered to the bearing assembly.

5. The rotor assembly of claim 1, wherein the impeller and the shroud are formed of plastic.

6. The rotor assembly of claim 1, wherein the shroud is mounted directly to the bearing assembly.

7. The rotor assembly of claim 1, wherein the impeller is a centrifugal impeller.

8. A turbomachine comprising a frame and a rotor assembly, the rotor assembly comprising a shaft, a bearing assembly, an impeller and a shroud, the impeller and the bearing assembly being mounted to the shaft, and the shroud being mounted to the bearing assembly so as to cover the impeller, wherein the shroud comprises a hub, a hood and a plurality of spokes that extend between the hub and the hood, the hub comprises a bore, and the bearing assembly extends through the bore and is secured to the hub, wherein the rotor assembly is mounted to the frame at the shroud or the bearing assembly, and wherein the impeller generates an airflow during operation of the turbomachine and the plurality of spokes are positioned upstream of the airflow relative to the impeller.

9. The turbomachine of claim 8, wherein the rotor assembly is mounted to the frame at the shroud and at the bearing assembly.

10. The turbomachine of claim 8, wherein the rotor assembly is soft mounted to the frame at the shroud or the bearing assembly.

11. The turbomachine of claim 10, wherein the rotor assembly is soft mounted to the frame by an o-ring located in a seat of the shroud or the bearing assembly.

12. The turbomachine of claim 8, wherein the shroud is mounted directly to the bearing assembly.

13. The turbomachine of claim 8, wherein the impeller is a centrifugal impeller.

14. A turbomachine comprising a frame and a rotor assembly, the rotor assembly comprising a shaft, a bearing assembly, an impeller and a shroud, the impeller and the bearing assembly being mounted to the shaft, and the shroud being adhered to the bearing assembly so as to cover the impeller, wherein the shroud comprises a hub, a hood and a plurality of spokes that extend between the hub and the hood, the hub comprises a bore, and the bearing assembly extends through the bore and is secured to the hub, wherein the rotor assembly is soft mounted to the frame at the bearing assembly and at the shroud, and wherein the impeller generates an airflow during operation of the turbomachine and the plurality of spokes are positioned upstream of the airflow relative to the impeller.

15. The turbomachine of claim 14, wherein the shroud is adhered directly to the bearing assembly.

16. The turbomachine of claim 14, wherein the impeller is a centrifugal impeller.

* * * * *